United States Patent [19]

Webber

[11] 4,331,195

[45] May 25, 1982

[54] CONTINUOUS CASTING MACHINE

[76] Inventor: C. Eugene Webber, 1040 Detwiler Dr., York, Pa. 17404

[21] Appl. No.: 51,611

[22] Filed: Jun. 27, 1979

Related U.S. Application Data

[63] Continuation-in-part of Ser. No. 931,956, Aug. 8, 1978, abandoned.

[51] Int. Cl.[3] ..... B22D 11/06

[52] U.S. Cl. ..... 164/431; 164/430

[58] Field of Search ..... 164/430, 431, 432, 87

[56] References Cited

U.S. PATENT DOCUMENTS

| | | | |
|---|---|---|---|
| 891,891 | 6/1908 | Weston | 164/430 |
| 1,139,884 | 5/1915 | Mellen | 164/430 |
| 1,139,889 | 5/1915 | Mellen | 164/430 |
| 1,841,297 | 1/1932 | Perry et al. | 164/430 X |
| 1,865,443 | 7/1932 | Perry et al. | 164/430 X |
| 1,870,406 | 8/1932 | Douteur | 164/430 |
| 2,169,893 | 8/1939 | Crampton et al. | 164/439 |
| 2,560,639 | 7/1951 | Giesler et al. | 164/430 X |
| 2,710,433 | 6/1955 | Properzi | 164/433 |
| 2,865,067 | 12/1958 | Properzi | 164/433 |
| 3,295,173 | 1/1967 | Webber et al. | 164/419 |
| 3,295,174 | 1/1967 | Webber et al. | 164/430 X |
| 3,342,251 | 9/1967 | Nagin et al. | 164/430 |
| 3,421,571 | 1/1969 | Webber et al. | 164/86 |
| 3,709,281 | 1/1973 | Bolliger | 164/430 X |

FOREIGN PATENT DOCUMENTS

| | | | |
|---|---|---|---|
| 876422 | 8/1961 | United Kingdom | 164/87 |

*Primary Examiner*—R. L. Spruill
*Assistant Examiner*—J. Reed Batten, Jr.
*Attorney, Agent, or Firm*—C. Hercus Just

[57] ABSTRACT

The present invention comprises several embodiments of a continuous casting machine for uninterrupted continuous production of non-ferrous metals and alloys, the machine having a pair of endless flexible mold assemblies, including mold blocks abutting each other in end-to-end relationship and each having a mold channel in one face thereof, whereby coengaging straight sections of the assemblies of mold blocks form a continuous mold cavity, extending forward and downward from the inlet end at an angle to provide desirable flow levels at the inlet of the cavity, the length of mold blocks in one assembly being preferably half the length of the mold blocks in the other assembly and indexed so that the abutting faces of the blocks of one assembly occur intermediately of the blocks of the other assembly to prevent heat dams from occurring. Drive is provided for only the inlet end of the lower mold assembly to push the mold blocks in the lower assembly into firm engagement with each other to provide a relatively smooth surface for the molded continuous product. In another embodiment, endless metal strips are positioned in the bottoms of the cavities of the mold blocks for numerous advantages.

14 Claims, 9 Drawing Figures

CONTINUOUS CASTING MACHINE

This application is a Continuation-in-part of Ser. No. 931,956, filed Aug. 8, 1978 and now abandoned.

BACKGROUND OF THE INVENTION

Continuous casting of metals of various kinds, both ferrous and non-ferrous, has been undertaken for many years. The majority of the prior art discloses machines in which the casting occurs in a vertical direction by discharging molten metal between pairs of grooved rollers or otherwise and flowing it downward between guides which are continually cooled. A typical disclosure of this type is shown in U.S. Pat. No. 2,169,893 to Crampton et al, dated Aug. 15, 1939.

In more recent years, continuous casting has taken place by utilizing a circular mold comprising a grooved wheel with which a metal belt cooperated to cover the groove and thereby constitute molding means for metal items of various cross-sections. Typical examples of molding apparatus of this type are disclosed in prior U.S. Pat. Nos. 2,710,433 and 2,865,067, both in the name of Properzi and respectively dated June 14, 1955 and Dec. 23, 1958. This results in crystalline grain boundaries which extend from the center to the corners of the bar when casting aluminum alloys and causes fracturing during rolling, especially in harder alloys.

Still more recently, the present applicant, in conjunction with George William Drescher, developed a continuous molding machine in which a rotatable circular mold member, having a peripheral groove cooperated with flexible endless molding means comprising molding blocks secured to chains and a span of said flexible molding blocks was moved in relation to a segment of the periphery of said grooved rotatable mold member, said machine being primarily related to forming clad bars of two different types of alloys and disclosures of this machine are found in U.S.Pat. Nos. 3,295,173, 3,295,174, and 3,421,571 in the name of Webber et al and respectively dated Jan. 3, 1967, Jan. 3, 1967 and Jan. 14, 1969, but such machines sometimes produce heat variations and ridges during solidification, causing fractures and surface defects.

Relative to developing the present invention, it has been found advantageous to utilize as molding means, a pair of endless, flexible mold assemblies comprising chains which support series of molding blocks having various shapes of cavities or other molding surfaces thereon, the blocks cooperating to form mold cavities therebetween into which molten metal is introduced. This type of machine presumably has not been very popular although examples of the same are disclosed in the following relatively old U.S. Pat. Nos. 891,891, to Weston, dated June 30, 1908; 1,841,297, and 1,865,443, both to Perry et al and respectively dated Jan. 12,1932 and July 5, 1932. An additional more recent machine of this general type is disclosed in U.S. Pat. No. 3,709,281 to Bolliger, dated Jan. 9, 1973. Possibly the reason for lack of use of such casting machines is that where the successive mold blocks abut each other, heat sinks occur which produce what is known in the industrial art as ‹hot shorts" that are brittle areas which crack and break when rolled to reduce diameter and otherwise.

The present invention includes certain innovations and improvements over prior art of the latter type, details of which are described hereinafter.

SUMMARY OF THE INVENTION

One of the principal objects of the present invention is to provide a continuous casting machine which enables the continuous production of a bar which is preferably generally circular in cross-section for best metallurgical structures suitable for immediate subsequent mechanical operation to reduce the diameter of the same to smaller dimensions, the machine providing for the continuous delivery of molten metal to a relatively straight span in each of a pair of cooperating endless flexible mold assemblies comprising upper and lower mold blocks respectively on endless chains and having cooperating mold cavities thereon which form a continuous elongated mold cavity extending forward and downward and of predetermined geometrical cross-sectional shape, the length of the bocks on one of said assemblies preferably being twice as long as the blocks on the other assembly, and said flexible assemblies being indexed in such a manner that the line of abutment of adjacent blocks on one assembly occurs intermediately of the ends of the blocks on the other assembly to prevent the formation of a transverse heat dam.

Another object of the invention is to dispose the longer blocks along the lower side of said cavity and guide the same around a supporting and drive wheel of very substantially greater diameter than a support and guide wheel located above the latter at the inlet of the straight mold cavity and around which the shorter blocks extend to be brought into registry with the longer blocks to form said elongated, straight mold cavity, whereby the longer blocks come into a straight line position sooner than if they were shorter, thus facilitating the formation of said straight cavity for reception of a stream of molten metal, and by having the two sets of blocks out of registry, the corners of the blocks of the respective sets do not interfere as they swing around the arc of the support and guide wheels incident to being brought into registry.

Still another important object of the invention is to extend said cooperating straight spans of said flexible mold assemblies so as to move downwardly and forwardly within the machine at an angle of preferably about 30° with the horizontal, whereby the molten metal delivered at such an angle aids in producing a solidification action nearer to a transverse direction than in other systems.

One further important object of the invention is to provide drive means for said endless flexible mold assembly by means which push the mold blocks of the lower endless flexible mold assembly into firm abutment with each other rather than having the blocks pulled along the guide means which suppot them, whereby a tighter block-to-block seal for the continuous elongated mold cavity is formed by the coaction of the straight spans of said endless flexible mold assemblies.

Still another important object of the invention is to provide guiding means for the flexible mold assemblies which include two zones, the first being fixed in length and spring-loaded to maintain alignment and contact between the coacting sections of said assembly, and the second zone, which is substantially two-thirds the length of the first zone, is pivotally connected to the inner end of the first zone in such manner as to allow limited movement of the opposite, outer end of said second zone so as to open the molds to desired amount and thereby reduce the effective length of the cooling zone.

A still further important object of the invention is to utilize molding surfaces in the molding blocks of the endless flexible molding systems which, in cross-section, are substantially semi-circular, whereby the coacting upper and lower mold blocks of the respective flexible mold system define a continuous elongated mold cavity which is substantially circular in cross-section and thereby, provide best metallurgical shape for further operations upon the product, such as the reduction in diameter thereof, and also provide best release from the molds to prevent any seizing or sticking of the product relative to the mold blocks during the discharge of the product from the endless flexible molding assemblies.

Still another object of a further embodiment of the invention is to provide continuous metal strips or belts which engage complementary flat surfaces in the bottoms of the mold cavities as the endless flexible mold assemblies advance and form the aforementioned elongated straight mold cavity for purposes of engaging the top and bottom surfaces of the cast bar formed in said mold cavity, thereby producing a continuous uniform section in the molds to form a surface formation relatively free of transverse mold marks, reduce the tendencies for heat dams occurring at the abutting ends of the mold blocks, provide better continuous heat removal from the cast bar during solidification, produce a heat removal surface that travels with the bar as formed and during cooling after the midpoint of the fixed die portion has been reached and help maintain contact with the bar for best uniformity of bar temperature while exiting from the machine, and also increase the mold life due to wear at the abutting ends of the mold blocks.

Details of the foregoing objects and of the invention, as well as other objects thereof, are set forth in the following specification and illustrated in the accompanying drawings comprising a part thereof.

DETAILED DESCRIPTION

Figure 1:
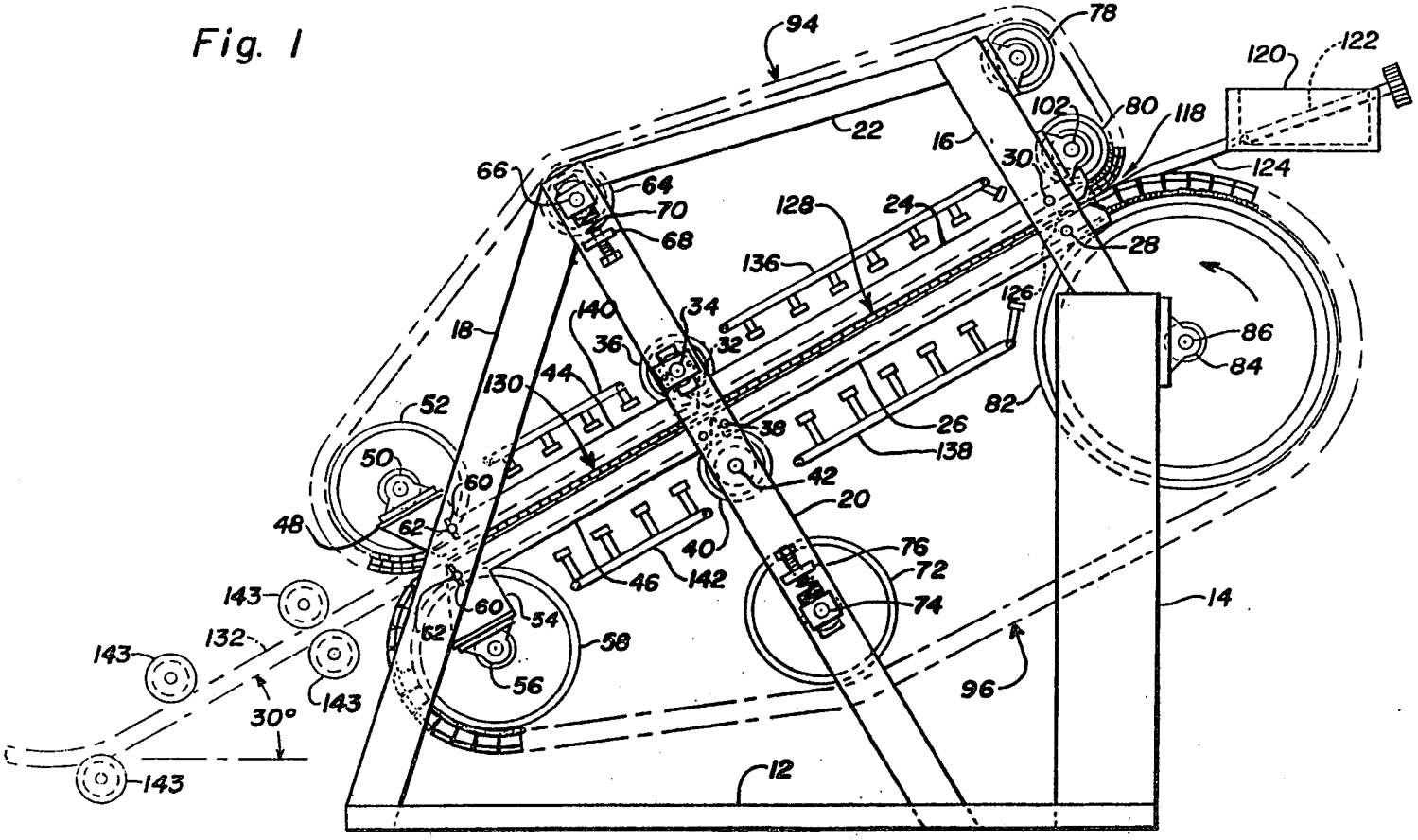
FIG. 1 is an exemplary side elevation of a continuous molding machine embodying the principles of the present invention.
Figure 2:
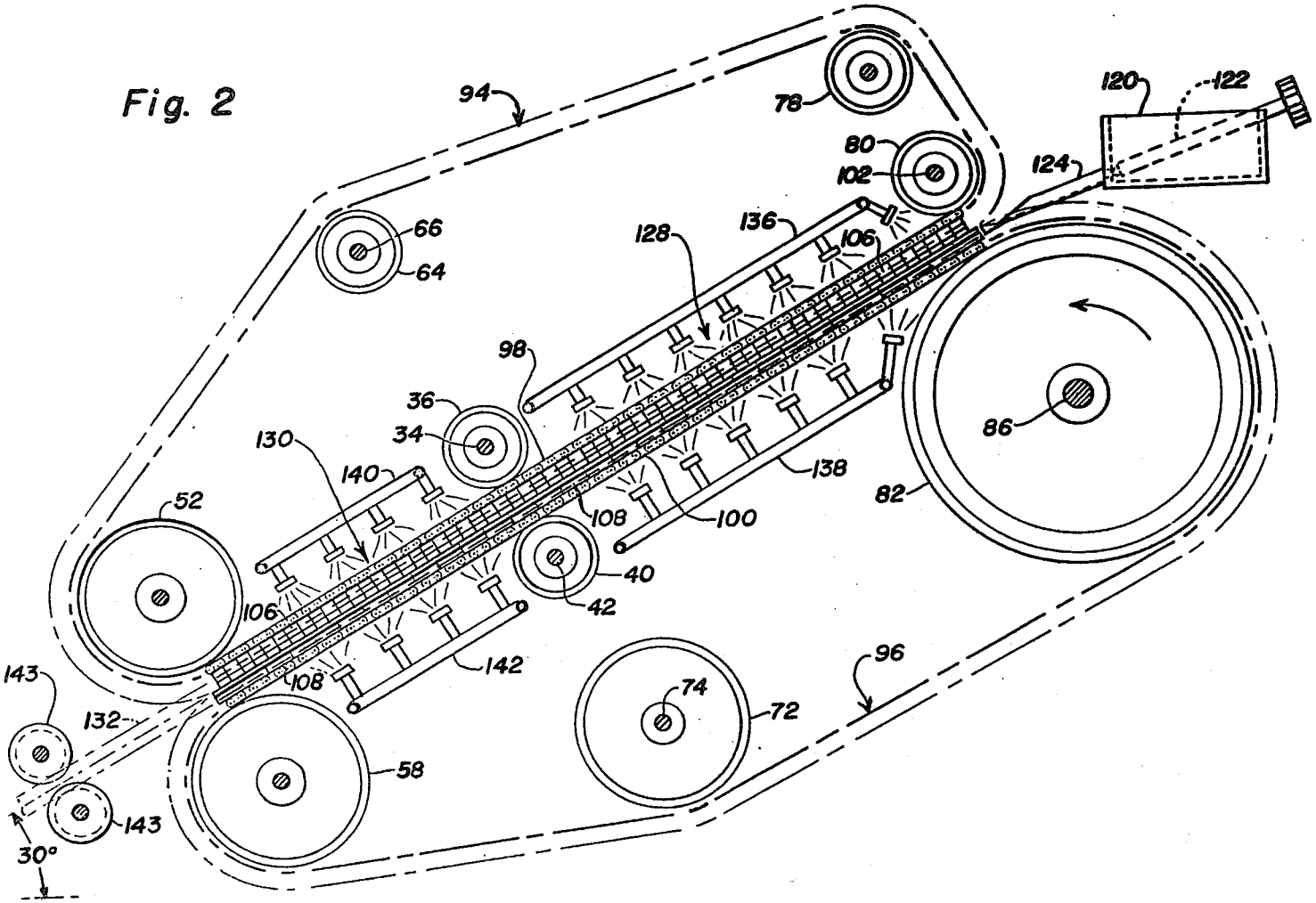
FIG. 2 is a side elevation of the machine shown in FIG. 1 but in which view the supporting guide members for the molding zones of the machine have been removed to provide a view of the coacting mold blocks of the upper and lower endless, flexible mold assembly.

Referring to FIGS. 1 and 2, one preferred embodment of the machine which includes the present invention is provided with a rigid frame, comprising one or more base members 12 from which, at one end, a vertical support 14 extends. At the upper end of said vertical support an additional frame member 16 is disposed at an angle to the support 14, the frame member 16 being adjacent the inlet end of the frame. At the opposite, exit end of the frame there is an upwardly and inwardly extending frame member 18, which is at an angular relationship with an additional angular frame member 20, the upper ends of the members 18 and 20 being connected to form a peak from which an upwardly and rearwardly additional top frame member 22 extends. It is to be understood that other appropriate framing means may be employed but the members just described, as illustrated in FIGS. 1 and 2, comprise a suitable basic frame to support the elements of the continuous molding machine comprising the present invention.

At opposite sides of the frame, first guide members 24 and 26 are mounted in parallel relationship to each other and extending at an angle of preferably about 30° to the horizontal. These guide members comprise straight rails which are shown in exemplary manner in cross-section in FIG. 5. The ends of the guide rails 24 and 26 nearest the inlet end of the frame are connected by suitable means to the frame members 16, such as by appropriate bolts or shafts 28 and 30, and the end of the guide rail 24 preferably has an oversize hole in the same to engage the bolt or shaft 30 in a manner to permit very limited movement to insure firm abutting, coengaging relationship of the mold blocks described hereinafter which are guided by the guide rails 24 and 26.

The lower, forward end of guide rail 24 has an extension 32, which is directed upwardly and a shaft 34 extends through the upper end thereof for limited vertical adjustment, said shaft also supporting a guide roller 36 which is mounted between the opposite, transversely spaced frame members 20. The forward, downward end of the guide rail 26 is preferably stationarily mounted with respect to frame member 20 by means of an appropriate bolt 38. The frame member 20 also supports an additional guide roller 40 mounted upon a shaft 42 extending between frame members 20.

Additional straight guide means in the form of a pair of upper guide rails 44 and lower guide rails 46 project forwardly and downwardly from the inner ends of the guide rails 24 and 26, respectively. The upper guide rails 44 have lateral extensions 48 and suppot on the upper ends thereof, bearings 50 upon which another guide roller 52 is rotatably supported. Correspondingly, the lower additional guide rails 46 have downwardly directed extensions 54 thereon, upon which bearings 56 are secured respectively to the lower ends thereof for supporting a still further guide roller 58, which is similar to guide roller 52. For purposes to be described, the forward lower ends of the additional guide rails 44 and 46, which are adjacent the discharge end of the machine, are provided with adjustable securing means which, as shown in exemplary manner in FIG. 1, comprise slots 60 which are formed in the transversely-spaced pair of frame members 18 and receive securing bolts 62 or other appropriate means, which are threaded into the extensions 48 and 54 for purposes of securing the discharge ends of the guide rails 44 and 46 in desired relationship with respect to each other. In general, however, the guiding path for the molding assemblies, described hereinafter, as provided by the upper and lower first guide members 24 and 26 and upper and lower additional guide members 44 and 46, is in a forward and downward angular direction which, as indicated above, is preferably about 30° to the horizontal for beneficial purposes described hereinafter.

The apex formed by frame members 18 and 20 supports an additional idler roller 64, which is a take-up roller. The roller is supported upon a shaft 66, which is adjustable by conventional means 68, preferably including a spring 70 to permit limited yieldability.

The additional frame members 20 also support near the lower ends thereof, an additional take-up roller 72, supported on a shaft 74 by similar conventional adjustable means 76 of the same nature as the adjustable means 68. Additional idler guide rollers 78 and driven roller 80 are supported by bearings fixed to frame member 16 and aligned with the axis thereof and the most important roller in the machine comprises drive roller 82, which is supported by fixed bearings 84 on vertical supports 14, a drive shaft 86 extending between said bearings, and having fixed to the outer end thereof, a drive gear 88 of relatively large diameter. The large drive gear 88 preferably is driven by a smaller pinion gear 90 mounted upon the drive shaft of electric motor 92, as shown in FIG. 3.

The continuous formation of a rod-type metal product, preferably of a transverse substantially circular shape, is formed by utilizing a pair of endless, flexible mold assemblies comprising an upper first assembly 94 and a second lower mold assembly 96. Said mold assemblies comprise endless chains 98 and 100, which are of the link-type, as best shown in enlarged manner in FIG. 4, particularly for purposes of providing spaces between alternate links in which cog-like projections on the drive roller 82 and driven roller 80 may be received to effect timing purposes for an important and essential feature of the invention described below. Such chains and toothed drive and driven rollers are of conventional type and details of the cogs thereon are not shown for purposes of simplifying the drawings.

Figure 3:
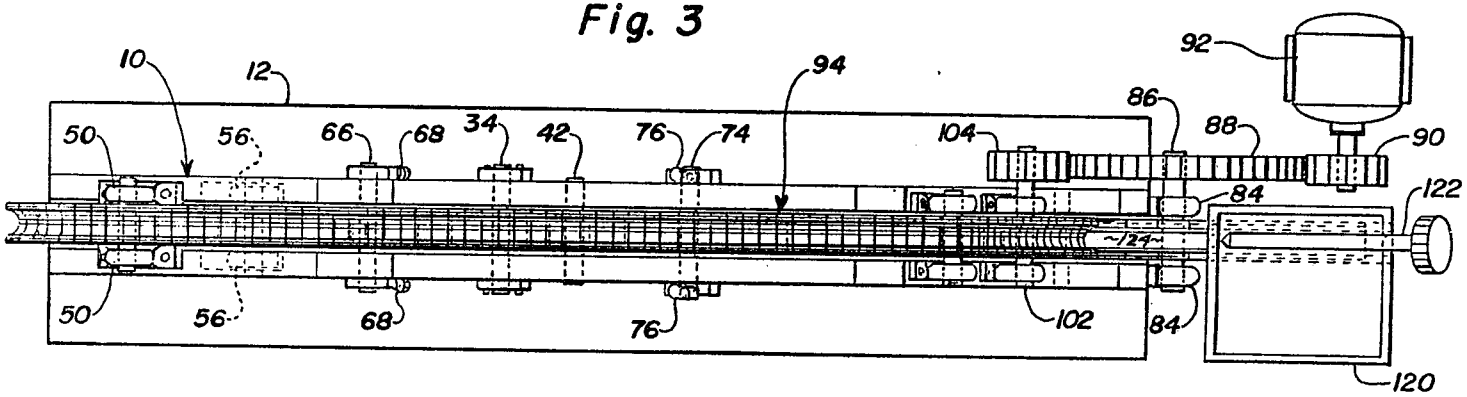
FIG. 3 is a top plan view of the molding machine shown in FIGS. 1 and 2.

To effect indexing between the upper and lower endless, flexible mold assemblies 94 and 96, shaft 102 has a driven gear 104 keyed thereto, see FIG. 3, which meshes with drive gear 88 and thereby effects indexing of the mold blocks 106 and 108 respectively supported upon the endless chains 98 and 100.

Figure 4:
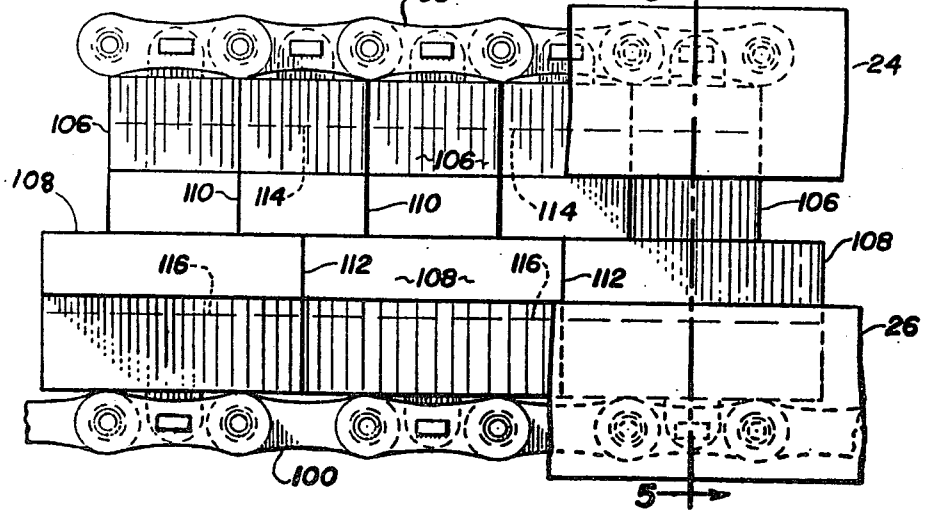
FIG. 4 is an enlarged, fragmentary section of the cooperating portions of the upper and lower endless, flexible molding assembly illustrated in a larger scale than shown in FIG. 2.
Figure 6:
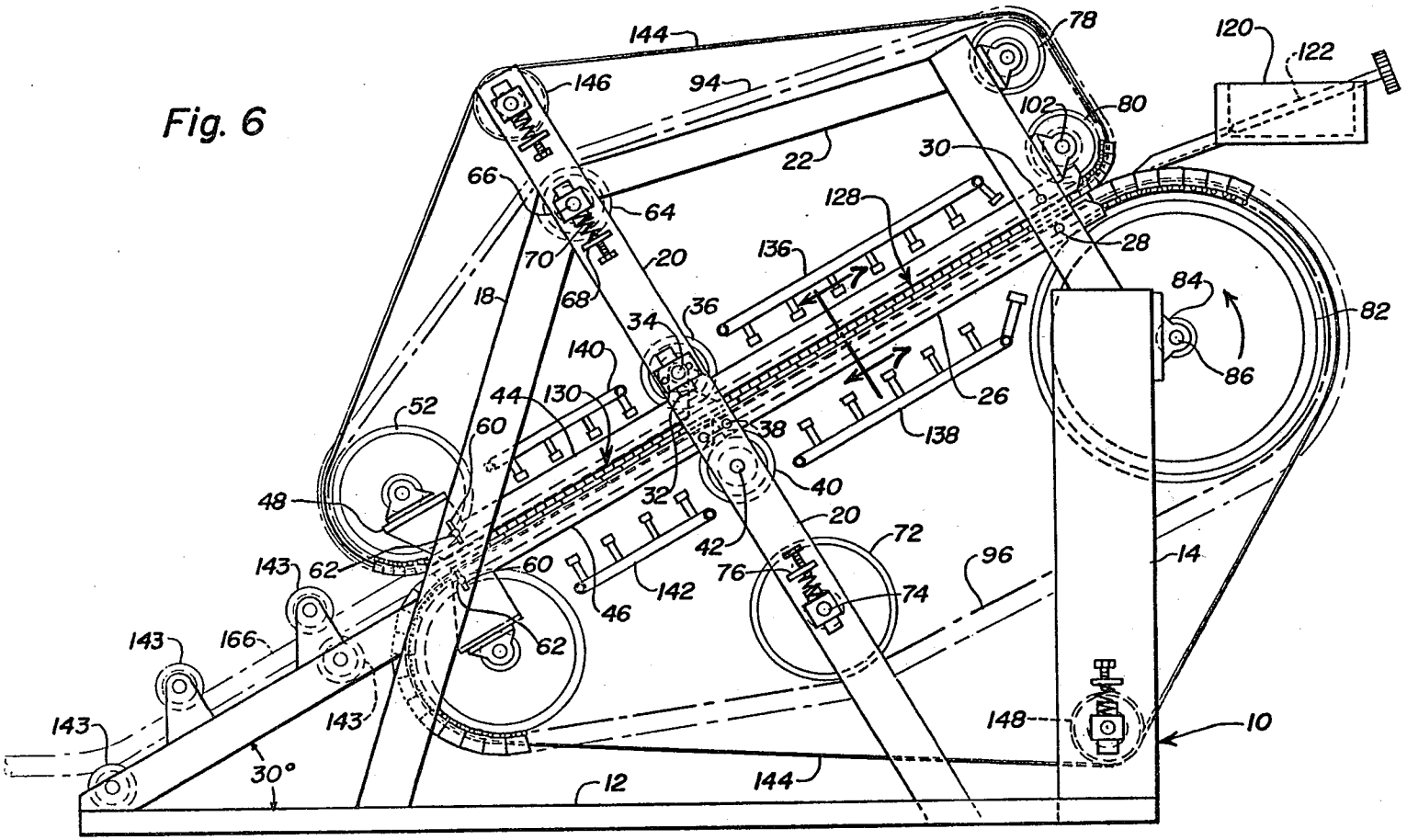
FIG. 6 is a side elevation of a continuous molding machine including another embodiment of the present invention.

From FIGS. 2 and 4, it will be seen that the mold blocks 106 on chain 98 of the upper, first mold assembly 94, preferably are exactly one-half the length of the mold blocks 108 on chains 100 of the lower, second mold assembly 96, whereby the abutting ends of the blocks 106 meet on lines 110, while the abutting ends of the mold blocks 108 meet on abutting lines 112 and, as best shown in FIG. 4, it will be seen that the lines 110 of the mold blocks 106 are intermediately of the ends of mold blocks 108 on chain 100 and, similarly, the lines 112 of abutting ends of the mold blocks 108 on chain 100 are preferably midway of the mold blocks 106 on chain 98. This arangement is highly advantageous for maintaining uniformity in the product by eliminating the possibility of heat dams being formed as occurs when, for example, the abutting ends of mold blocks on two cooperating assemblies thereof, are coincident with each other as is found in the prior art exemplified by certain of the patents cited hereinabove.

Figure 5:
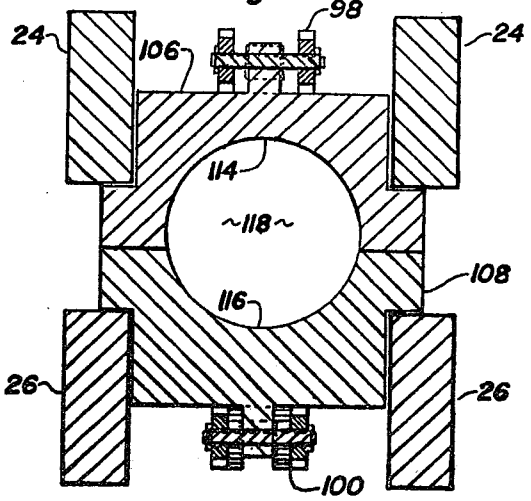
FIG. 5 is a fragmentary cross-sectional view showing the transverse shape of a pair of the cooperating molding blocks of the machine as seen on the line 5—5 of FIG. 4 thereof.

The mold blocks 106 and 108 are made of suitable metal and respectively have complementary mold channels 114 and 116 which, as shown in FIG. 5 in cross-section, form a substantially circular product of continuous elongated mold cavity 118, clearly shown in the center of FIG. 5, Preferably, the channel is not perfectly circular because the mold channels 114 and 116 in cross-section are not exactly semi-circular but, preferably, the opposite ends thereof do not extend to a plane intersecting the axis of the substantially semi-circular shape of said channel for purposes of providing the best in metallurgical shape for the product, coupled with best release from the mold channels to prevent any seizing or sticking during the separation of the mold blocks from the stabilized product, especially at the discharge end of the frame of the machine. Such shape also is advantageous when being processed subsequently by further reduction in diameters and it also has been found that for these purposes, a cross-section of polygonal nature, especially a polygon approaching a circle, is the most advantageous as distinguishing from square or rectangular cross-sections, especially for purposes of reducing the cross-sectional area of the product, in that the non-circular configurations tend to split and otherwise have undesirable characteristics.

Molten metal, especially non-ferrous metal, is introduced to a tundish 120, which serves as a reservoir therefor, and a controlled discharge therefrom is effected by the exemplary valve member 122. The molten metal flows along a delivery channel 124 and is introduced into the inlet end of the elongated continuous mold cavity 118, where the metal assumes a level indicated by the line 126, which comprises a better flow pattern due to the downward and forward angular relationship of the elongated mold cavity 118 with respect to the horizontal, said angle preferably being approximately 30° and facilitates the flow of the molten metal into cavity 118 for even distribution therein. The metal initially flows between the initial portion of the primary zone 128, see FIGS. 1 and 2, which is defined by the length of the first guide members 24 and 26 and then is delivered to the auxiliary or secondary zone 130, formed by the additional guide rails 44 and 46, the latter zone being approximately one-half the length of the initial or primary zone. The purpose of using the two different zones is that the mold blocks of the straight span effected by the first guide rails 24 and 26 are in close abutment with each other so as preferably to prevent any appreciable leakage from the opposite sides or between the abutting ends of the mold blocks thereof. However, due to the adjustability afforded by the slots 60 and bolts 62, the guide rails 44 and 46 of the auxiliary zone, which are pivoted at their inner ends, may be separated predetermined distances, as desired, adjacent the discharge end of the auxiliary zone 130, and thereby facilitate or regulate the cooling of the molded product 132, which has been stabilized during its movement through the initial or primary zone 128. Additional supplemental guide rollers disposed in suitable locations beyond the discharge end of the machine, which are of an idler nature, direct the product to additional equipment, such as spools or further diameter-reducing rollers, such as used in conventional practice, to receive the product from various types of continuous casting machines, as exemplified by rollers 143 in FIGS. 1 and 2.

It will be noted that drive roller 82 is of substantially greater diameter than roller 80 which guides the lower span of blocks of the upper mold assembly of short blocks around an arc and into abutting face engagement with the longer blocks of the lower mold assembly 96. The preferred ratio of the diameters of said rollers, as shown in FIGS. 1 and 2, is approximately 4:1. This arrangement has distinct advantages due to the fact that the lower longer blocks which traverse the arc of the large drive roller 82 come into a straight line sooner than if they were shorter blocks. Also, the gap between adjacent ends of the longer blocks just prior to reaching the straight line position is smaller than the similar gaps between adjacent smaller blocks in the upper mold assembly, especially under the circumstances of the shorter blocks 106 traversing the arc of the smaller guide roller 80. Further, by such an arrangement, the two sets of relatively smaller and larger blocks are out of registry at the corners of the respective sets and, therefore, do not interfere with each other as they swing around the arcs of the respective rollers 80 and 82 and move into straight line position to form the elongated continuous mold cavity 118.

Primary cooling of the continuous molded product 132, as it progresses along the elongated continuous mold cavity 118, is accomplished preferably by conventional water sprays 136 and 138, respectively above and below, as it passes through the straight spans of the mold assemblies 94 and 96. Supplemental cooling also is effected by the additional water sprays 140 and 142 respectively disposed above and below the relatively straight spans of the upper and lower mold assemblies 94 and 96 disposed in the secondary zone 130.

Another important feature of the present invention is the fact that the main drive roller 82, which is of the largest diameter of any in the machine, rotates counterclockwise, as indicated by the directional arrow in FIG. 1, and thereby pushes, as distinguished from pulling, the chains of the lower, second mold assembly 96 of longer blocks 108, and thereby forces the abutting ends of said mold blocks 108 into firm abutting relationship. Similarly, due to the fact that the additional roller 80 likewise is driven due to it being indexed for movement with the main drive roller 82, similarly pushes a straight span of the chains of the upper, first mold assembly 94 in a manner to force the abutting ends of the mold blocks of said assembly into firm, non-leaking engagement with each other. Such pushing also is to be noted as occurring in a forward and downward direction within the confines of the machine and, as indicated hereinabove, said angle has been found to be highly effective when of the order of approximately 30° to the horizontal.

A further important embodiment of the invention constituting a further development of the embodiment shown in FIGS. 1–5 is illustrated in FIGS. 6–9. Basically, the embodiment illustrated in FIGS. 6–9 comprises all of the features illustrated in FIGS. 1–5 with respect to the basic frame, the drive means and the downward and forward sloping arrangement of the mold cavity within which the continuous casting of rods and the like occurs. Further, the relative lengths of the individual mold blocks respectively provided in the upper and lower endless flexible mold assemblies, together with the respective lengths of the mold blocks of said upper and lower assemblies disposing the abutting ends of the mold blocks in said assemblies respectively out of registry with each other to prevent heat dams from occurring which give rise to the formation of brittle, hot, short areas in the molded product that cause fracture and disintegration, particularly when being reduced to smaller diameters by conventional rolling techniques.

Further to increase the minimization of the occurrence of heat dams in the endless flexible mold assemblies, particularly in the spans thereof, which form the elongated, straight mold cavity between the facially abutting mold blocks of the respective endless flexible mold assemblies, the embodiment of the invention illustrated in FIGS. 6–9 employs endless metal bands 144, which respectively extend around the upper mold assembly 94 and the lower mold assembly 96. The circumferential length of said endless metal bands is greater than that of the endless mold assemblies, whereby as clearly shown in FIG. 6, the upper portion of the upper metal band 144 and the lower portion of the lower metal band 144 extend respectively above and below the upper and lower portions of the flexible mold assemblies 94 and 96. To support and accomplish said positions of said upper and lower portions of the metal bands, take-up or tensioning rollers 146 and 148 are respectively supported by frame members 20 and 14, said rollers basically being similar to the rollers 64 and 72 of the embodiment shown in FIGS. 1–5.

The endless metal bands preferably are formed of low carbon steel which is somewhat soft and various alloys in which the steel is the major proportion may be used. Said bands are relatively thin and preferably of the range of between 0.030 inches and 0.040 inches thick but such specified dimension is not to be considered restrictive. The allow selected for the formation of such bands also should be one to render them wear-resistant and capable of reasonably long life.

Figure 7:
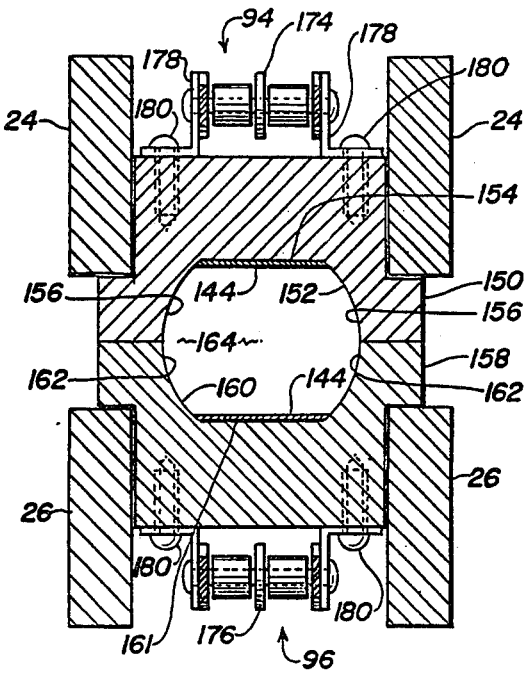
FIG. 7 is an enlarged cross-sectional view of a transverse pair of cooperating mold blocks of the embodiment shown in FIG. 6 as seen along line 7—7.
Figure 9:
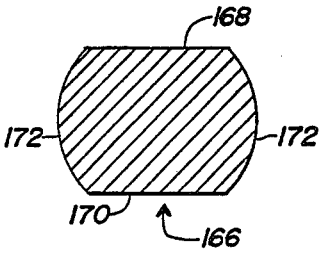
FIG. 9 is an exemplary cross-sectional view of a cast bar formed by the embodiment of FIGS. 6–8.
Figure 8:
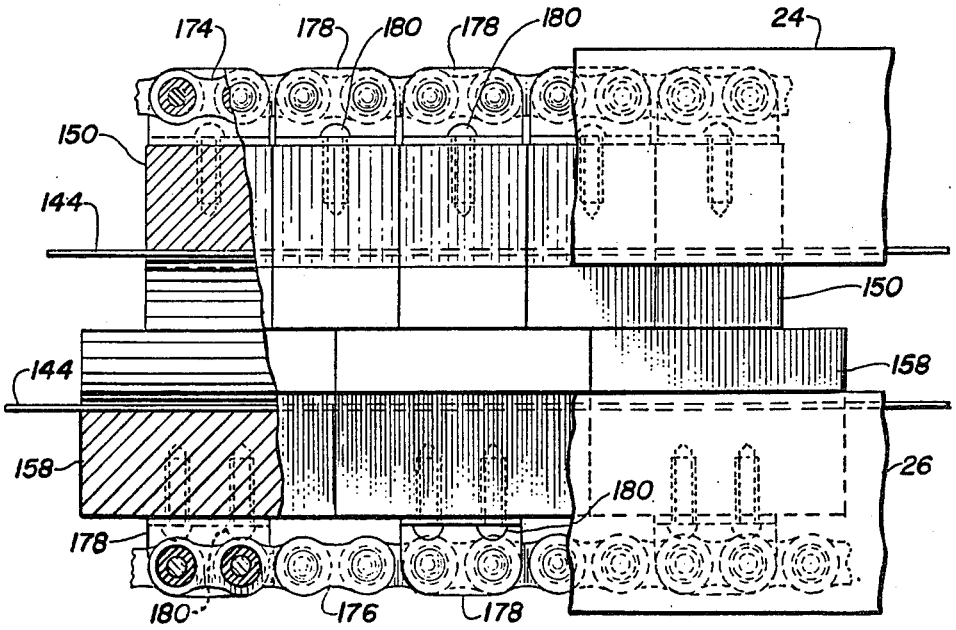
FIG. 8 is a fragmentary enlarged side elevation of a part of the molding area of the embodiment shown in FIG. 6, parts being broken away to illustrate details of other parts.

Referring to FIG. 7, it will be seen that in cross-section, the mold blocks 150 of the upper mold assembly, which correspond to the blocks 106 of the embodiment shown in FIGS. 1–5, have a mold channel 152, the innermost surface 154 of which is flat and the width thereof is complementary to the width of the metal band 144 which is disposed therein in operation. The opposite sides 156 of the channel 152 extend outward and away from the flat innermost surface 154.

Similarly, the mold blocks 158 of the lower mold assembly which correspond to the blocks 108 of the embodiment shown in FIGS. 1–5 in function, are provided with an innermost flat surface 161 to accommodate the band 144 disposed therein. Preferably, the bands 144 respectively disposed in the blocks 150 and 158 are of equal width and thickness, the channel 160 in the blocks 158 also having sides 162 which extend outwardly and away from the innermost flat surface 161, whereby the channels 152 and 160 are similar to each other and the continuous mold channel 164 formed by the individual channels 152 and 160 produce a cast rod 166 which has upper and lower flat surfaces 168 and 170 and similarly curved sides 172, whereby the product somewhat resembles a hexagon but also, for purposes of being rolled into circular configurations in cross-section, may be considered generally circular and readily adapted to be reduced in diameter to form rods or wire substantially of true circular cross-section.

It will be understood that the upper mold blocks 150 are of a preferred fraction of the length of the lower mold blocks 158, such as one-half the length thereof, whereby when the respective endless flexible mold assemblies which embody said molds are indexed, as described with respect to the embodiment shown in FIGS. 1-5, the line of abutting ends of the blocks 150 will always be out of registry with the lines of abutting ends of the lower blocks 158 and thereby minimize the occurrence of heat dams, as described above, which when present, tend to form what is known in the casting industry as hot-shorts in the cast products that are brittle and non-homogeneous with other portions of the cast product, whereby when rolled to smaller diameters, fractures and disintegrations occur due to said hot-shorts being present.

It also can be appreciated that because of the continuous nature of the metal bands 144 and the disposition thereof in the so-called bottoms of the mold channels 152 and 160 of the mold blocks of the upper and lower mold assemblies presents a continuous uniform section, top and bottom, in the mold and effects a surface formation that is free of transverse mold marks, as well as reducing the presence of heat dams at the ends of each mold block. Further, said continuous metal bands effect a more continuous heat removal from the bar during the solidification thereof than under circumstances where such metal bands are not employed. In addition, said bands provide a heat-removal surface that is movable with the cast product during the latter cooling thereof, particularly while the product and bands are moving through the auxiliary or secondary zone 130, where the mold assemblies gradually move apart, as described in detail with respect to the embodiment shown in FIGS. 1-5, and thereby help to keep bar contact to provide best uniformity of bar temperature as it exits from the casting machine.

A further side benefit resulting from the use of the bands 144 is a tendency to increase mold life and minimizing wear at the mold joints. By providing tension upon the endless metal bands 144 through the employment of the rollers 146 and 148, it will be seen that the spans of the bands which are disposed in the upper and lower surfaces of the continuous straight mold cavity 164 will be maintained in taut condition, due to further to the fact that the mass of metal being introduced into the mold cavity forces the upper and lower spans of said metal bands 144 against the bottom surfaces in the respective mold blocks.

The upper and lower mold assemblies 94 and 96 in the embodiment shown in FIGS. 6-9 comprise chains 174 and 176 which, while functioning similarly to the chains 98 and 100 of the embodiment shown in FIGS. 1-5, nevertheless, preferably are in the form of double chains as clearly shown in FIG. 7. L-shaped brackets 178 have upstanding arms fixed to the links of the chain by the chain rivets and the horizontal arms of said bracket are secured by screws 180 to the outer flat faces of the individual mold blocks 150 and 158.

From the foregoing, it will be seen that the present invention introduces a number of individually relatively simple but in the aggregate, an arrangement of characteristics which result in not only a highly uniform product, but, in particular, interrelated features which result in a relatively simple machine for continuously molding a rod-type metallic product from molten metal, especially molten non-ferrous metal.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A machine for continuously casting bar products of non-ferrous metals comprising in combination, a frame having inlet and discharge means at opposite ends, a lower endless flexible mold assembly including a plurality of similar mold blocks each having a mold channel in one face carried by endless chain means and the ends of said blocks directly abutting each other to form a continuous molding channel when moving along a straight path, first substantially straight guide means supported by said frame and engageable by said blocks for support and direction of movement, said guide means extending forwardly and downwardly from said inlet end of said frame to guide a straight span of said mold assembly in molding position, an upper endless flexible mold assembly including a plurality of similar mold blocks of different length from the blocks of said lower mold assembly and each having a mold channel in one face thereof, second substantially straight guide means above said first guide means and parallel thereto and operate to support and guide a straight span of said mold blocks of said upper mold assembly in abutting overlying relationship with the blocks of said lower mold assembly, the blocks of said lower mold assembly being at least twice as long as the blocks of said upper mold assembly, thereby to dispose the abutting ends of the mold blocks in said two mold assemblies respectively out of registry with each other to prevent heat dams from occurring, the cooperating mold channels of the two mold assemblies forming a continuous elongated mold cavity of predetermined geometrical cross-sectional shape, means continuously to introduce molten metal into said cavity adjacent the inlet end of said frame and form the same into a continuous cast rod, means including rotatable guide wheels above and below said first and second guide means and at least adjacent the inlet and discharge ends of said guide means respectively to support the portions of said endless flexible mold assemblies opposite and at the ends of said straight spans thereof for continuous movement, the guide wheel adjacent the inlet end of the frame for the lower mold assembly being of substantially larger diameter than the corresponding guide wheel for the upper mold assembly, and drive means operable to push said straight span of said lower assembly of larger mold blocks along said first guide means to maintain the ends of the mold blocks thereon in firm abutment with each other, means to index said lower and upper mold assemblies to maintain the abutting ends of the mold blocks of said two assemblies out of registry with each other as aforesaid and thereby minimize the occurrence of heat sinks and hot shorts in the continuous cast rod, additional straight guide means extending longitudinally outward from the inner end of said first mentioned guide means toward the discharge end of said frame, said aforementioned guide means comprising elongated straight guide rails slidably engaged by said mold blocks, means supporting the guide rails of said first mentioned guide means stationarily relative to said frame, means supporting one end of the guide rails of the additional guide means for limited pivotal movement relative to said inner end of said first guide means, means supporting the opposite ends of the guide rails of said additional guide means for limited movement toward and from the straight path of movement of said mold assemblies, whereby said opposite ends of said guide rails of said additional guide means may be moved limited distances away from each other to separate the mold blocks of the opposing mold assemblies to facilitate the cooling of the continuously moving cast rod in passing from the discharge end of said frame, and spray means mounted longitudinally above and below the spans of said endless mold assemblies moving along said stationary and movable straight guide means to facilitate the solidifying of the continuous cast rod.

2. The machine according to claim 1 in which the outer ends of said guide rails of said additional guide means have bearings mounted therein, guide rollers having shafts supported in said bearings and said endless flexible mold assemblies respectively extending around said guide rollers, and adjustable means connected to said frame adjacent the discharge end thereof and engageable with said outer ends of said guide rails of said additional guide means to adjust said rollers and the spans of said mold assemblies extending therearound toward and from each other to facilitate the cooling of the continuous cast rod as aforesaid.

3. The machine according to claim 1 further including guide rollers supported by said frame in transverse alignment relative to the guide rails for rotation upon shafts mounted in bearings on said frame adjacent the inner ends of said first mentioned guide rails and respectively engaging said endless flexible mold assemblies, adjustable means on said frame connected to the bearings for said uppermost guide roller to permit limited adjustment of the end of said upper mold assembly engaged thereby, and adjustable take-up rollers also supported by said frame engageable respectively with the uppermost and lowermost spans respectively of the lower and upper flexible mold assemblies.

4. The machine according to claim 1 in which all of said guide rails extend generally along a straight path disposed substantially at an angle of approximately 30° to the horizontal, thereby providing a desirable flow level for molten metal as introduced to the inlet end of the continuous mold cavity formed by the coengaged mold blocks of the lower and upper endless flexible mold assemblies.

5. The machine according to claim 1 further including an endless metal band extending around each of said endless flexible mold assemblies and having spans disposed respectively in the bottoms of at least the mold blocks of the spans of said mold assemblies moved along and forming said continuous elongated mold cavity, whereby said spans of said metal bands within said bottoms of said mold blocks engage the upper and lower surfaces of the cast rod formed by said mold cavity and thereby effecting efficient heat removal from the cast rod and minimizing the occurrence of heat dams by said mold blocks and corresponding hot shorts in the cast rod.

6. The machine according to claim 5 further including additional guide wheels supported by said frame above and below the outermost portions of said endless flexible mold assemblies and adapted to tension the spans of said metal bands respectively in said continuous elongated mold cavity.

7. The machine according to claim 6 further including tensioning wheels supported by said frame and respectively engaging the outermost portions of said metal bands to effect said tensioning of said spans of said bands within said mold cavity.

8. The machine according to claim 5 further characterized by the innermost surface portions of the channels in said mold blocks being flat and parallel to the outer faces of said blocks, and said metal bands also being flat and engaging said flat surfaces in said channels in said mold blocks.

9. The machine according to claim 8 in which said innermost flat surfaces in said channels of said mold blocks are of uniform width and said metal bands having a width complementary to that of said flat surfaces of said cavities of said mold blocks.

10. The machine according to claim 8 in which said channels in said mold blocks have curved sidewalls extending respectively outward and upward from the opposite side edges of said innermost flat surfaces in said channels to the outer surfaces of said blocks which abut corresponding surfaces of the blocks of the opposite flexible mold assembly when moving along said straight guide means on said frame and form a cast rod somewhat hexagonal in cross-sectional shape.

11. The machine according to claim 5 in which portions of said endless metal bands extend beyond the discharge means of said continuous elongated mold cavity, thereby providing a heat removal surface associated with said mold cavity that is movable with the cast rod during solidification thereof and facilitate uniformity of temperature of the rod during solidification while exiting.

12. A machine for continuously casting bar products of non-ferrous metals comprising in combination, a frame having inlet and discharge means at opposite ends, a first endless flexible mold assembly including a plurality of similar mold blocks each having a similar mold channel in one face and connected to endless chain means, the ends of said blocks directly abutting each other to form a continuous molding channel when moving along a straight path, first substantially straight guide means supported by said frame end engageable by said blocks for support, a second endless flexible mold assembly including a plurality of similar mold blocks of different length from the blocks of said first mold assembly and each having a mold channel in one face thereof, second substantially straight guide means above said first guide means and parallel thereto and operable to guide a span of said mold blocks of said second mold assembly in abutting overlying relationship with the blocks of said first mold assembly, the cooperating mold channels of the two mold assemblies forming a continuous elongated mold cavity of predetermined geometrical cross-sectional shape, means to drive said assemblies in indexed relationship to each other, means to introduce molten metal into said cavity adjacent the inlet end of said frame, and similar endless flexible metal bands extending respectively around said endless flexible mold assemblies and having spans disposed within the bottoms of said mold channels in the blocks of said endless assemblies thereof while moving along said straight guide means to form said mold cavity and thereby provide a continuous uniform section in said cavity free of mold marks and also provide improved continuous heat removal from the cast bar product during solidification thereof while moving along said cavity.

13. The machine according to claim 12 in which said endless flexible metal bands are relatively thin and flat and the innermost surfaces of the mold channels in said mold blocks are complementary to said flexible metal bands to flatly accommodate said bands.

14. The machine according to claim 12 further including take-up and tensioning rollers supported by said frame outward from said guide means and endless flexible mold assemblies and within the plane of movement of said metal bands and endless flexible mold assemblies, said take-up and tensioning rollers engaging said flexible metal bands and operable to maintain the spans thereof within said elongated mold cavity taut and straight.

* * * * *